United States Patent [19]

Creagan

[11] Patent Number: 4,702,800

[45] Date of Patent: Oct. 27, 1987

[54] HORIZONTAL TWIN WIRE PAPER MACHINE

[75] Inventor: Richard W. Creagan, Kirland, Canada

[73] Assignee: The Black Clawson Company, Middletown, Ohio

[21] Appl. No.: 935,446

[22] Filed: Nov. 26, 1986

[51] Int. Cl.[4] ..... D21F 1/00; D21F 7/00

[52] U.S. Cl. ..... 162/300; 162/263; 162/301; 162/348

[58] Field of Search ..... 162/300, 301, 303, 348, 162/263, 198, 273

[56] References Cited

U.S. PATENT DOCUMENTS 4,532,008 7/1985 Creagan et al. ..... 162/301

*Primary Examiner*—S. Leon Bashore

*Assistant Examiner*—K. M. Hastings

*Attorney, Agent, or Firm*—Biebel, French & Nauman

[57] ABSTRACT

Apparatus for the purpose of enabling a paper mill to determine the extent to which the performance and/or the product of an existing Fourdrinier paper machine in the mill will be improved by its conversion into a top former machine comprises a fractional version of top forming apparatus which can be readily combined with an existing Fourdrinier machine in such manner that a minor portion of the forming width of the machine will be converted to top forming operation. The apparatus makes it possible to produce, on an existing Fourdriner machine, a sheet of which a small integral portion is formed by drainage through both the primary wire and a top wire, while the remainder of the sheet continues to be produced in the same manner as before the top wire testing.

7 Claims, 9 Drawing Figures

HORIZONTAL TWIN WIRE PAPER MACHINE

BACKGROUND OF THE INVENTION

This invention relates generally to paper making machines of the Fourdrinier type wherein the paper is formed on an essentially horizontal run of forming wire traveling from the breast roll to the couch roll. The invention is more specifically directed to a recent trend in Fourdrinier machines wherein a second wire is mounted on top of the primary wire downstream from the breast roll so that liquid is expressed from the stock on the primary wire through both wires. This type of combined machine is now commonly referred to as a "top former" machine, and as background for the description of the present invention, the best example of a top former machine is shown in Creagan et al U.S. Pat. No. 4,532,008 issued July 30, 1985 to the assignee of the present invention.

SUMMARY OF THE INVENTION

This invention has as a primary object the provision of test apparatus for the purpose of enabling a paper mill to determine the extent to which the performance and/or the product of an existing Fourdrinier paper machine in the mill will be improved by its conversion into a top former machine.

More specifically, the invention provides what is in effect a fractional version of top forming apparatus which can be readily combined with an existing Fourdrinier machine in such manner that a minor portion of the forming width of the machine will be converted to top forming operation. In other words, the invention makes it possible to produce, on an existing Fourdrinier machine, a sheet of which a small integral portion, preferably adjacent one edge thereof, is formed by drainage through both the primary wire and a top wire, while the remainder of the sheet continues to be produced in the same manner as before the top wire testing.

A particular objective and accomplishment of the invention is to provide such test apparatus which can be quickly and easily combined with an existing Fourdrinier machine without in any way modifying the existing structure or otherwise interfering with the conventional operation of the machine. This result is accomplished by providing the apparatus of the invention as a self-contained unit which can be inserted into an existing Fourdrinier machine from one side thereof without interrupting or otherwise interfering with the regular operation of the other parts thereof.

The manner and means by which these objects and advantages are achieved are pointed out below in connection with the description of the preferred embodiment of the invention.

DESCRIPTION OF THE PREFERRED EMBODIMENT

Figure 1:
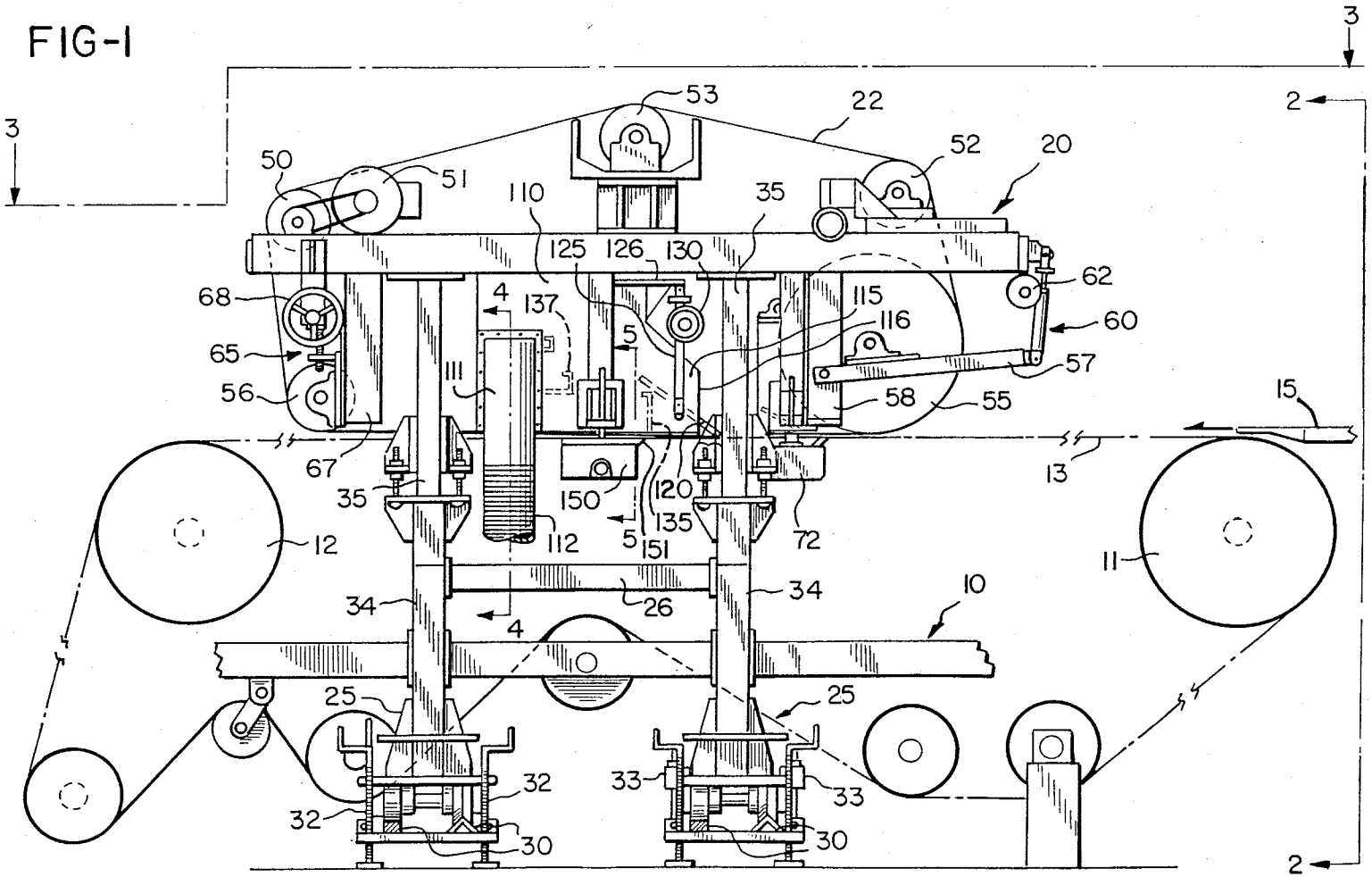
FIG. 1 is a side elevational view showing a mobile top former unit in accordance with the invention in combination with an existing Fourdrinier machine.
Figure 2:
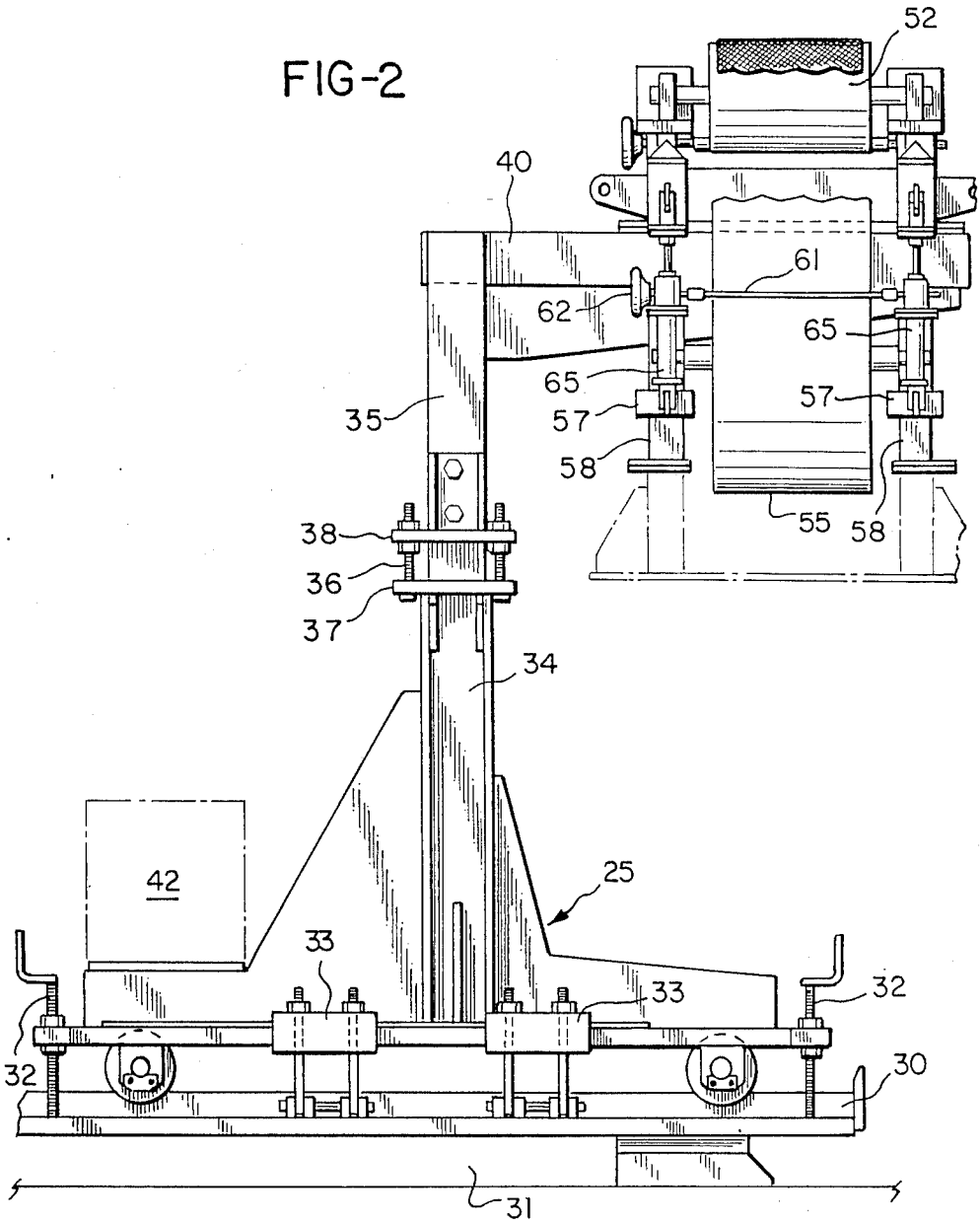
FIG. 2 is an elevation of the unit of the invention viewed looking from right to left as indicated by the line 2—2 in FIG. 1.

FIG. 1 shows in phantom outline the basic elements of the existing Fourdrinier paper machine with which the invention is combined, including main frame means designated generally as 10 which support the breast roll 11, suction couch roll 12, and the usual wire return rolls for supporting the primary forming wire 13. A headbox 15 at one end of the frame 10 delivers a flow of stock at the breast roll 11 onto the upstream end of the horizontal forming run of wire 13 for drainage through the wire to effect formation of a sheet.

All of the operating parts of the apparatus provided in accordance with the present invention are supported in a supplemental frame designated generally at 20. The primary operating part is a relatively narrow endless wire loop 22 of substantially less length than the primary wire 13, satisfactory results in the testing of the invention having been obtained with this top wire only 16 inches in width as compared with primary wires 13 which may be several hundred inches in width.

The supplemental frame 20 is supported on a mounting by which it can be moved laterally of the front side of the main frame 10 into and out of overlying relation with a portion of the primary wire 13 adjacent the front side of the paper machine. Stand means for this purpose comprise a pair of carriages 25 interconnected by one or more cross braces 26, and each carriage is supported for rolling movement to and away from the main frame 10 on a track assembly 30 firmly secured to the floor and preferably also to the same front sole plate 31 as the frame 10. Lock screws 32' hold each carriage 25 in fixed position with respect to the frame 10, with the aid of hook clamps 33 mounted on at least one of the track assemblies 30.

Each carriage 30 includes a vertical hollow column 34, preferably of square section, in which a vertical column 35 is telescoped for vertical adjustment, relatively fine adjustment being provided by bolts 36 connecting complementary angle brackets 37 and 38 on the columns 34 and 35 respectively. A cantilevered arm 40 projects at right angles from the upper end of each column 35 to serve as direct support for the supplemental frame 20. A counterweight 42 on the opposite side of each carriage 30 from arms 40 contributes to stability of the apparatus as a whole.

Figure 3:
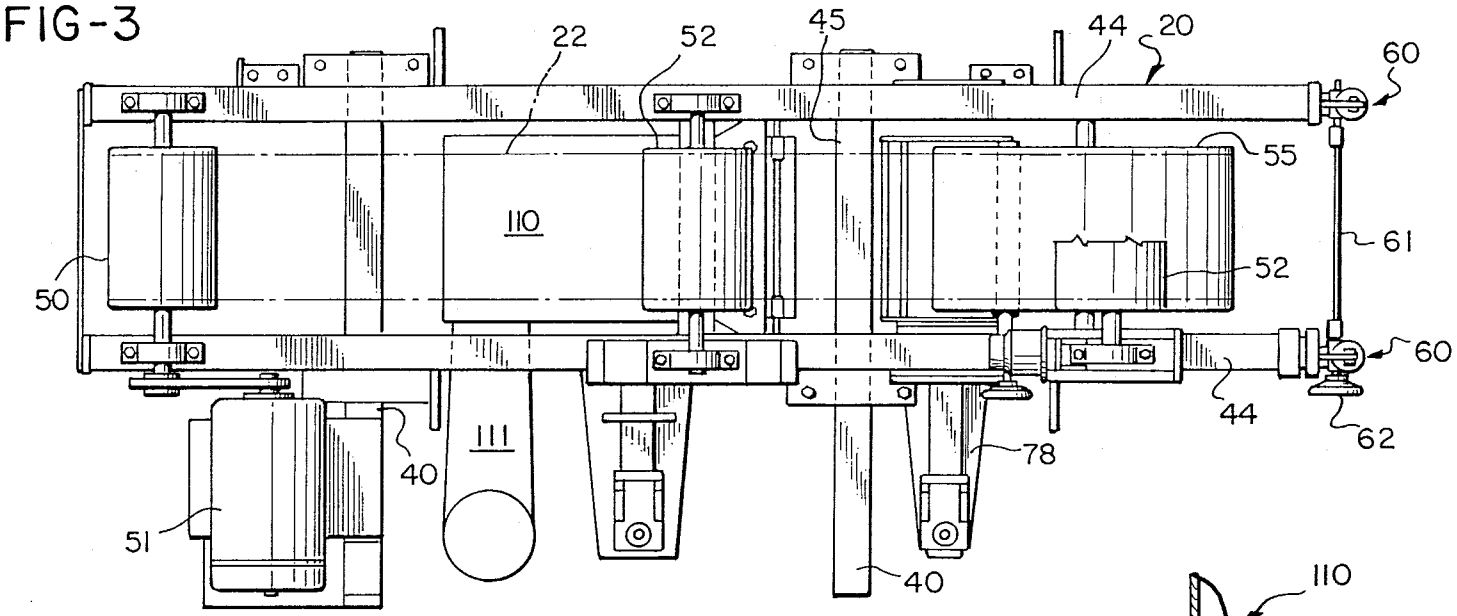
FIG. 3 is a plan view of the apparatus of FIGS. 1–2 as indicated by the line 3—3 in FIG. 1.
Figure 4:
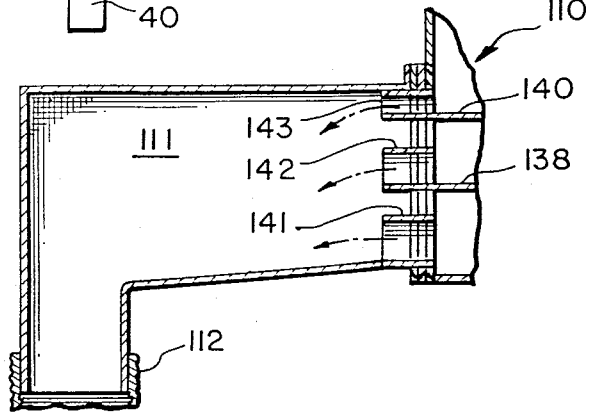
FIG. 4 is a fragmentary section on the line 4—4 in FIG. 1.
Figure 5:
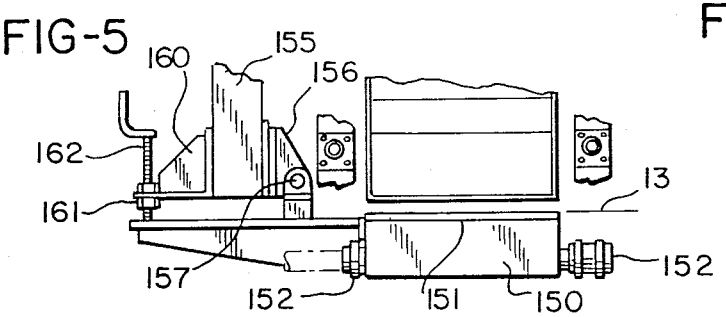
FIG. 5 is a fragmentary section on the line 5—5 of FIG. 1.

As best seen in FIG. 3, the supplemental frame 20 comprises a pair of beams 44 of rectangular section which extend the full length of the supplemental frame and are secured together by cross beams 45 at spaced locations along their length. The beams 44 rest on and are secured to the cantilever arms 40, and they should be of sufficient length to position the top wire 22 in overlying relation with the primary wire 13 without interference with any part of the existing machine. For a form of the invention wherein the wire 22 is 16 inches wide as stated above, this result is readily accomplished if the arms 44 are approximately 80 inches in length, and the preferred lateral location of wire 16 is with its outer edge aligned with the front edge of wire 13.

The top wire 22 is supported on supplemental frame 20 by five rolls, a drive roll 50 having its drive motor 51 mounted on frame 20, a tensioning roll 52 mounted for movement lengthwise of frame 20, a guide roll 53, and a pair of vertically adjustable rolls 55 and 56 which support the generally horizontal run of wire 22 that cooperates with the forming run of the primary wire 13.

The roll 55 at the upstream end of this run has its journals mounted on a pair of arms 57 pivotally supported at one end in a pair of hangers 58 depending from the beams 44. The other end of each of these arms 57 is adjustably supported by a jack assembly 60 from the upstream end of the beam 40 thereabove, this pair of jack assemblies having a common operating shaft 61 provided with an operating hand wheel 62. A similar jack assembly 65 provides for adjustment of the bearings for each journal of the roll 56 on a hanger 67 depending from near the downstream end of each beam 40, and this pair of jacks also has a common operating shaft and handle wheel 68.

Vertical adjustment of the rolls 55 and 56 on frame 20 regulates the maximum vertical spacing between the forming run of the top wire 22 above the primary wire 13 for a specific vertical position of frame 22 on stand 25. In addition, two deflectors for supporting the forming run of wire 22 are mounted for vertical and angular adjustment on the supplemental frame 20, and another two deflectors are suspended from the supplemental frame 20 in supporting relation with the forming run of the primary wire 13 and in alternating relation lengthwise of the machine with the deflectors for the top wire.

Figure 7:
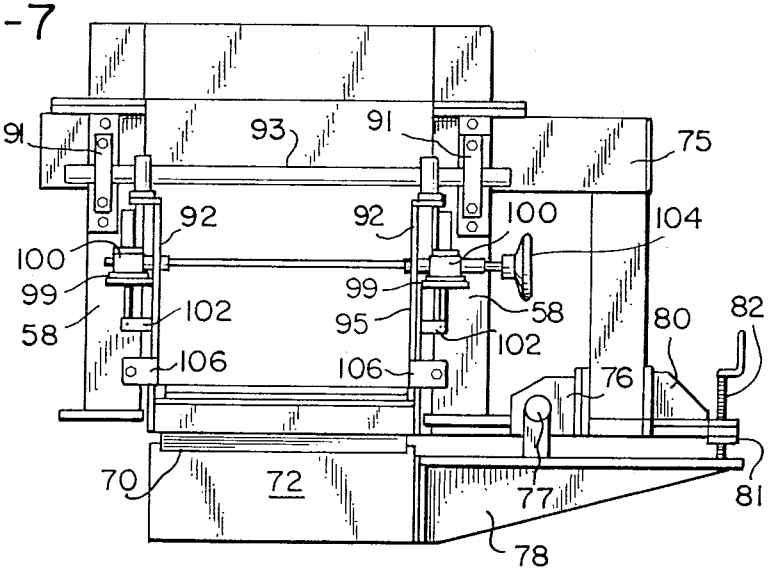
FIG. 7 is a fragmentary section, on a different scale, on the line 7—7 of FIG. 1 and FIG. 6.
Figure 9:
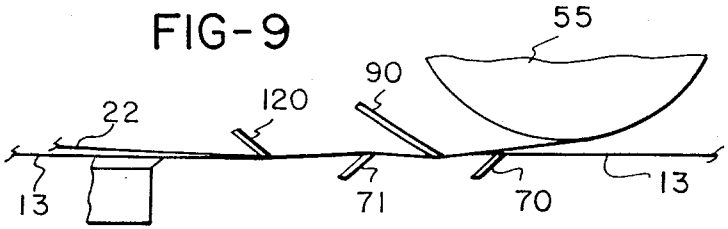
FIG. 9 is a diagrammatic side view illustrating the operation of the invention.
Figure 6:
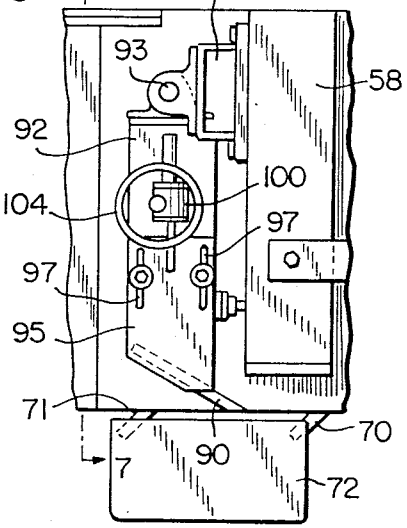
FIG. 6 is a fragmentary view, on a larger scale, of a portion of FIG. 1.
Figure 8:
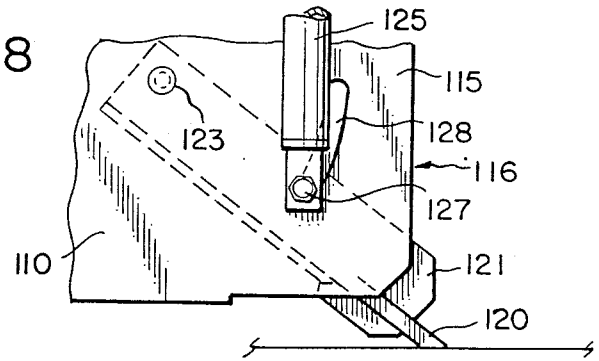
FIG. 8 is a fragmentary view, on a larger scale, of a portion of FIG. 1.

The deflectors 70 and 71 for the bottom wire are mounted on top of the front and back sides of an open box-like housing 72 which extends under the wire 13 as best seen in FIG. 7. This deflector assembly is supported by a right angled hanger arm 75 which depends from the front beam 40. A bracket 76 on the back side of the lower end of this arm provides a pivotal mounting 77 for an arm 78 projecting from the front of the deflector housing 72.

Another bracket 80 on the front of the lower end of hanger arm 75 provides a threaded mounting 81 for a threaded crank 82, the lower end of which engages the outer end of the arm 78. Threaded movement of crank 82 will cause the entire lower deflector assembly to swing about its pivotal mounting 77, and the deflectors 70–71 can in this manner be brought into the properly aligned relation with the underside of the primary wire 13. Whatever vertical adjustment is needed for this deflector assembly is carried out by vertical adjustment of the columns 35 on carriages 30, by means of the bolts 36 and brackets 37–38 as already described.

The first of the deflectors for the top wire 22 is a blade 90 provided with a vertically and angularly adjusting mounting on the supplemental frame 20 and located with its working edge in approximately equidistant relation with the two primary wire deflectors 70–71. This mounting comprises a bracket 91 on the downstream side of each of the hangers 58 and a support arm 92 mounted for swinging movement on a shaft 93 journalled in the brackets 91. The blade 90 is secured at its opposite ends to a support plate 95 which is mounted for vertical adjustment on the adjacent arm 92 by a series of shoulder screws 96 mounted in the arms 92 through slots 97 in the supports 95.

A bracket 99 on each arm 91 supports the drive mechanism of a jack assembly 100 having its adjustable part 101 connected to a bracket 102 on the adjacent deflector support 95. These two jack assemblies are operated simultaneously by the shaft 103 by means of the hand wheel 104 on the front end of this shaft. Angular adjustment of the deflector blade 90 about the shaft 93 is effected by a pair of bolts 105 each of which is threaded into one or the other of the hangers 58 through an angle bracket 106 on the deflector support arm 92.

The white water expressed through the wire 22 which travels up the deflector 90 is carried by its own momentum into a saveall 110, which is a sheet metal enclosure of generally rectangular outline having an outlet housing 111 on its front end from which a hose or pipe 112 leads to the white water pit. On its upstream side, the saveall 110 has an extension 115 which is open at 116 along both its bottom and the side facing upstream to receive liquid from the deflector 90.

The second deflector for the wire 22 is a blade 120 mounted for swinging movement in the opening 116 by an arm 121 at each end which is pivotally mounted at 123 on the adjacent end wall of the saveall 110. Adjustment of the deflector arms 121 about the pivotal mounting 123 is effected and controlled by a pair of jack assemblies 125, each of which is pivotally mounted at the upper end thereof on a bracket 126 secured to the top of the saveall 110. The bottom end of each jack assembly is pivotally connected to the associated arm 121 by a cap screw 127 extending from the run 121 through an arcuate slot 128 in the wall of the saveall 110. The jack assemblies 125 are operated by a common shaft having a hand wheel 130 at the front of the unit.

The volume and velocity of liquid deflected into the saveall 110 vary with the speed of the paper machine, and the internal construction of the saveall 110 accordingly includes partition walls at three levels for ensuring that all liquid deflected into its interior will be retained therein until it is drained therefrom by way of the outlet housing 111 and drain line 112. As shown in FIG. 1, the first of these partition walls 135 is located just inside the opening 116 at the upstream end of the saveall. The second partition wall 137 is located at a higher level and near the middle of the saveall, and it includes a shelf portion 138 extending to the downstream wall of the saveall. The third partition wall 138 is located somewhat higher and further back inside the saveall, and it also is at the front edge of a shelf portion 140. These partitions in effect provide the interior of the saveall with three liquid-collecting levels, each of which has its own outlet 141, 142 and 143 into the outlet housing 111.

In addition to the deflectors 70–71 which support the primary wire 13, the supplemental frame 20 carries a suction box 150 which extends below the wire 13 just downstream from the second top wire deflector 120 and has a blade member 151 on its upstream edge and connection means 152 at both ends thereof for alternative connection to a suction box source such as the same source as the suction boxes already present on the Fourdrinier machine. The suction box 150 is supported by a right angled hanger arm 155 like the hanger arm 75, which depends from the front beam 40. A bracket 156 on the back side of the lower end of this arm 155 provides a pivotal mounting 157 for an arm 158 projecting from the front of the suction box 150.

Another bracket 160 on the front of the lower end of hanger arm 155 provides a threaded mounting 161 for a threaded crank 162, the lower end of which engages the outer end of the arm 158. Threaded movement of crank 162 adjusts the angular relation of suction box 150 with wire 13, and vertical adjustment of this suction box assembly is effected by vertical adjustment of the supplemental frame as a whole as described in connection with the bottom deflectors 70–71. If the existing paper machine has its first suction box at an appropriately convenient location, it may be used in place of the suction box 150.

In order to use the testing apparatus of the invention as it is intended to be used with an existing Fourdrinier paper machine, the track assemblies 32 are first installed on the floor of the mill. If there is a hand rail extending in front of the horizontal run of the wire 13, a section thereof must be removed to make room for the top wire unit of the invention, which, however, need not be more than about 11 feet long from end to end.

The supplemental frame 20, with all its associated parts, is preferably mounted on the arms 40 and prepared for use while the stand 25 is retracted from the Fourdrinier machine to the outer end of the tracks 32, and the entire unit is then advanced along the tracks until it is in a position wherein the wire 22 has its outer edge in approximately direct line with the outer edge of the primary wire 13. During these initial procedures, the rolls 55 and 56 are set at heights which will provide a predetermined space between each of these and the wire 13, satisfactory results having been obtained with a space of 0.375 inch for roll 55 and 1.50 inch for roll 56. Also, both of the upper deflectors 90 and 120 are preferably raised so that the wire 22 is supported out of contact with the primary wire 13. Note that all of these operations can be carried out while the paper machine is in normal operation.

After the apparatus of the invention is properly in place, the deflectors 90 and 120 are lowered into their desired positions. For the first deflector 90, this will usually be with its bottom edge substantially in coplanar relation with the two deflectors 70–71 supporting the primary wire. Similarly the lower edge of the second top wire deflector 120 is preferably in or slightly below the plane defined by the deflector 71 and the blade 151 on the suction box 150. Note that these adjustments are made while the paper machine continues to operate.

After these adjustments have been completed, the sheet will be formed by twin-wire operation along the strip of the primary wire 13 which underlies the top wire 22, while conventional single wire formation will continue to take place across the rest of the machine. More specifically, the stock which enters the wedge zone defined by the converging portions of the opposed wire runs from the roll 55 to the deflector 90 will be subject to compression between the converging wire runs and the resulting expression of liquid through both wires.

This action will be accentuated as the sandwich of wire-stock-wire travels past the deflectors 71 and 90 to the second deflector 120 for the top wire, which will be a relatively flat S-course with the deflectors positioned as described. Formation is therefore completed before this sandwich passes deflector 20, and immediately thereafter, the top wire 22 is guided upwardly by the roll 56, while the newly formed sheet is held on the primary wire 13 by the suction box 150 for travel to and beyond the couch roll 12 in the usual way.

The resulting sheet will have the unique characteristic of including a strip formed by twin-wire operation which is integral with sheet formed by the conventional single wire technique. The two types of sheet are easily compared, after the usual pressing and other finishing operations, in order to determine the differences therebetween, which can be expected to include distinctly improved characteristics from the standpoint of reduction of two-sidedness.

The apparatus of the invention thus makes it easy for a paper mill to determine whether the results achieved by top wire formation justify conversion of a particular conventional machine to top former operation. It also makes it possible to investigate different combinations of deflector spacings and the initial angle of convergence of the opposed forming runs of the two wires, as well as different speeds of operation. All of these advantages are made available with no modification of the existing paper machine and therefore no effect on its operation after the test unit of the invention has been removed. Indeed, the paper produced during testing could be included in the regular product of the mill, or if desired, the 16-inch strip of twin-wire sheet could be trimmed away in order to have the salable product uniform across its width.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Apparatus for testing the combination of a top forming wire with a Fourdrinier paper machine in combination with a Fourdrinier paper machine including a main frame whereon are mounted means supporting a substantially horizontal run of a primary endless forming wire of predetermined width amd length, and headbox means for delivering a flow of paper making stock to the full width of said wire run for drainage therethrough to form a paper sheet thereon, comprising:

(a) means defining a supplemental frame of substantially shorter length and width than said wire run, (b) stand means including cantilevered arm means for supporting said supplemental frame adjacent one side of said main frame with said arm means in overlying relation with said primary wire run, (c) means for securing said supplemental frame to said arm means in overlying a portion of said primary wire run, (d) means including two rolls mounted adjacent opposite ends of said supplemental frame supporting a second endless forming wire of substantially less width than said primary wire with a substantially horizontal run of said second wire overlying said primary wire run, (e) means for effecting vertical adjustment of each of said two rolls on said supplemental frame to establish a desired vertical relation between each end of said second wire run and said primary wire run, (f) deflector means carried by said supplemental frame in supporting relation with said second wire run between said rolls for maintaining said second wire run in pressure relation with the stock on said primary wire run while scraping liquid from the inner surface of said second wire run, and (g) saveall means mounted on said supplemental frame for receiving and collecting liquid from said deflector means, (h) whereby the sheet formed on said machine includes an integral portion formed by drainage through both of said wire runs while the remainder thereof is formed by drainage through only said primary wire.

2. Apparatus as defined in claim 1 wherein said paper machine is mounted on a floor and further comprising track means for mounting said stand means for movement on said floor toward and away from said main frame.

3. Apparatus as defined in claim 1 further comprising deflector means carried by said supplemental frame below and in supporting relation with said primary wire run at positions alternating lengthwise of said run with said deflector means supporting said top wire run.

4. Apparatus as defined in claim 3 further comprising an arm depending from the front of said frame, and means forming a cantilevered mounting on said arm for said primary wire deflector means.

5. Apparatus as defined in claim 4 further comprising means for effecting vertical adjustment of said supplemental frame on said stand means to vary the vertical position of said primary wire deflector means.

6. Apparatus as defined in claim 1 further comprising suction box means carried by said supplemental frame below and in supporting relation with said primary wire run closely downstream from said deflector means for said top wire run for holding said sheet on said primary wire run while said top wire run is separated therefrom by the downstream one of said rolls.

7. Apparatus as defined in claim 6 further comprising an arm depending from the front of said frame, and means forming a cantilevered mounting on said arm for said suction box means.

* * * * *